US008141709B2

(12) United States Patent
Klaus

(10) Patent No.: US 8,141,709 B2
(45) Date of Patent: Mar. 27, 2012

(54) PACKAGING UNIT WITH PROTECTIVE SECTION

(75) Inventor: Renner Klaus, Ettlingen (DE)

(73) Assignee: Klocke Verpackungs-Service GmbH, Weingarten (DE)

( * ) Notice: Subject to any disclaimer, the term of this patent is extended or adjusted under 35 U.S.C. 154(b) by 0 days.

(21) Appl. No.: 12/389,216

(22) Filed: Feb. 19, 2009

(65) Prior Publication Data

US 2009/0205993 A1 Aug. 20, 2009

(30) Foreign Application Priority Data

Feb. 19, 2008 (DE) ..... 10 2008 009 713

(51) Int. Cl.
*B65D 73/00* (2006.01)

(52) U.S. Cl. ..... 206/484; 222/107

(58) Field of Classification Search ..... 206/461, 206/229, 469, 467, 470, 216, 484; 222/107, 222/541.1, 484, 216, 541.6, 541.9; 604/403
See application file for complete search history.

(56) References Cited

U.S. PATENT DOCUMENTS

| | | | | |
|---|---|---|---|---|
| 2,103,389 | A * | 12/1937 | Salfisberg | 222/107 |
| 3,224,640 | A * | 12/1965 | Schneider et al. | 222/107 |
| 3,741,384 | A * | 6/1973 | Cloud | 206/461 |
| 3,862,684 | A * | 1/1975 | Schmitt | 206/277 |
| 3,930,500 | A * | 1/1976 | Mohrke et al. | 222/106 |
| 4,921,137 | A * | 5/1990 | Heijenga | 222/107 |
| 6,174,083 | B1 * | 1/2001 | Delefortrie et al. | 383/200 |
| 6,557,731 | B1 | 5/2003 | Lyon et al. | |
| 6,705,541 | B2 * | 3/2004 | Schuehrer et al. | 239/34 |
| 7,506,762 | B2 * | 3/2009 | Nelson et al. | 206/484.1 |
| 2007/0228073 | A1 * | 10/2007 | Mazzarino | 222/107 |

FOREIGN PATENT DOCUMENTS

| | | | |
|---|---|---|---|
| CH | 686777 | A5 | 6/1996 |
| DE | 7246179 | U | 9/1973 |
| DE | 202004000591 | U1 | 3/2004 |
| EP | 1234521 | A | 8/2002 |
| WO | 9810993 | A | 3/1998 |

* cited by examiner

*Primary Examiner* — Mickey Yu
*Assistant Examiner* — Chun Cheung
(74) *Attorney, Agent, or Firm* — Browdy and Neimark, PLLC

(57) ABSTRACT

A packaging unit having two planar elements arranged on each other to form, by virtue of being spaced apart in certain regions, a closed chamber and that are joined to each other in a collar region encircling the chamber, the collar region being bounded by an outer edge. The chamber has, for controlled dispensing of a medium stored therein, a tapering extending into a detachable section that is detachable from the collar region and on which a predetermined break line intersecting the tapering is provided for creating an opening at the tapering. Provision is made that the detachable section is bounded by a material weakening that is recessed at a distance from the outer edge into the collar region and separates the detachable section from a protective section of the collar region that covers the detachable section toward the outer edge.

21 Claims, 8 Drawing Sheets

PACKAGING UNIT WITH PROTECTIVE SECTION

BACKGROUND OF THE INVENTION

The present invention relates to a packaging unit for packaging and apportioning of a medium, for example in the fields of medicine, cosmetics, chemistry, or the food industry, which packaging unit has two planar elements arranged on each other that are made up, for example, of foils, bowl-shaped or lid-like plastic parts, or of a combination of a sturdy plastic part with a foil.

The term "planar" in this context is intended merely to express that the elements substantially cover a surface area, which does not mean, however, that they must, in particular, be designed flat; rather they may also have certain contours. The two planar elements form, by virtue of being spaced apart from each other in certain regions, a closed chamber. The planar elements are joined to each other in a collar region that encircles the chamber, with the collar region being bounded by an outer edge.

To provide for a controlled dispensing of a medium stored in the chamber, the chamber has a tapering that forms an outlet path that is connected to the chamber and can be opened to the outside. To this effect, the tapering extends into a detachable section that is detachable from the collar region. This detachable section is connected to the remaining collar region via a predetermined break line that intersects the tapering, with the predetermined break line serving to create the opening at the tapering.

The patent document DE 201 02 348 U1 discloses a packaging unit that is supported on another packaging. This packaging unit consists of a chamber portion and a detachable portion that are connected to each other via a predetermined break line. To open a chamber of the packaging unit, the predetermined break line is broken and the detachable portion is removed from the chamber portion in the process, during which process a pipette-like tapering is opened at the same time that is connected to the chamber.

A packaging unit of this type can be opened comfortably without auxiliary means and permits a precise dispensing of the medium that is contained in the chamber.

Because of the easy-to-open design of the packaging unit, there exists the risk, however, that the detachable portion may be unintentionally folded over relative to the chamber portion so that the pipette-like tapering may be prematurely opened in the process, and the medium may consequently leak out in an uncontrolled fashion.

BRIEF SUMMARY OF THE INVENTION

The present invention serves to prevent the above-mentioned shortcomings in a packaging unit of this type and to prevent, despite the convenient way of opening the chamber, an unintentional leaking-out of the medium that is stored in it.

This is achieved with a packaging unit in which the detachable section is bounded by a material weakening that is recessed at a distance from the outer edge into the collar region and separates the detachable section from a protective section of the collar region that covers the detachable section toward the outer edge.

The detachable section is bounded by a material weakening region that is recessed into the collar region at a distance from the outer edge and separates the detachable section from a protective section of the collar region. This protective section covers the detachable section toward the outer edge. In this manner, the detachable section and the predetermined break point can be shielded and stabilized against inadvertently applied forces, so as to prevent a premature unintentional breaking of the predetermined break point, for example during transport or storage of the packaging unit, and thereby prevent the medium that is stored in the chamber from leaking out.

It is advantageous in this context if the at least one protective section has, in extension of the predetermined break line, a bending stiffness that is greater than the bending stiffness at the predetermined break line. In this manner, the protective section serves to stabilize the predetermined break line against an unintentional snapping off of the detachable section.

To achieve this effect, the predetermined break line is advantageously bounded by the material weakening, thereby guaranteeing in a particularly simple manner an increased bending stiffness of the unweakened protective section relative to the predetermined break line.

It is additionally advantageous if the collar region has, in extension of the predetermined break line, at least one stabilizing means, whereby the protection against an unintentional breaking of the predetermined break line can be improved further.

The stabilizing means is advantageously formed by a deep-drawn region that is recessed into the protective section of the collar region. Such a deep-drawn region makes it possible to provide added stiffness to the protective section, thereby increasing its bending stiffness and the protection against a snapping off of the detachable section.

Additionally, it is advantageous if the deep-drawn region extends in a U-shape about the detachable section, thereby rendering the same particularly sturdy.

According to a particularly advantageous embodiment, the material weakening has two weakened sections that extend on opposite sides of the tapering crosswise, or transverse, to the predetermined break point. In this manner, the predetermined break line can be covered at both ends by a protective section.

The weakened sections advantageously extend in each case on both sides to the outer edge, thereby enabling the at least one protective section to be completely removed from the remaining packaging unit when the medium is about to be applied. In the process, the detachable section is freed, and can now be removed by breaking the predetermined break line to open the outlet path of the tapering to the outside.

Alternatively, the material weakening extends in a U-shape about the tapering. The weakened sections in this case are formed by segments of the material weakening. In this manner, a single continuous protective section can be defined that covers the predetermined break line at both ends. When detaching this single protective section, both ends of the predetermined break line can thus be freed simultaneously to open the packaging unit.

In this context it is advantageous if the U-shaped material weakening extends on both sides to the outer edge. This enables the protective section to be completely removed, thereby making the predetermined break line particularly easily accessible for opening the packaging unit.

In an alternative embodiment, the U-shaped material weakening has two ends that are situated at a distance from the outer edge. In this manner, on the one hand, all substantial parts of the packaging unit remain together even after opening of the same, thus permitting an at least almost complete disposal of the same. On the other hand, it is possible in this embodiment to use the protective section that is deflected, or bent, or folded over, relative to the remaining collar region as a support whereby the packaging unit is able to stand up. In this manner, the packaging unit can be set down substantially upright after opening of the tapering, without the medium being able to leak out from the chamber.

Additionally, it is advantageous if the material weakening is formed over its entire length by a cut, thereby preventing particularly well the transfer of an externally acting force from the protective section to the detachable section, which, in turn, reduces the risk of an inadvertent breaking off of the detachable section.

In this context, it is advantageous if multiple adhesion points are provided over the length of the cut in order to prevent an inadvertent removal of the protective section from the detachable section and a resulting freeing of the predetermined break line.

According to an alternative embodiment, the material weakening is formed by a perforation, which guarantees, even with certain actions of force as they may occur during transport, for example, a reliable retention of the protective section in its position covering the detachable section.

Furthermore, the predetermined break line is advantageously formed by creasing and scoring, or by a perforation, thereby permitting the amount of force that is required for detaching the detachable section to be predefined particularly precisely.

According to an additional embodiment, a peelable foil is provided that adheres to the detachable section and to the protective section. This requires that the foil must first be removed from the remaining packaging unit, in order to then be able to remove the protective section from the detachable section and ultimately snap off the detachable section. This makes it possible to make the packaging unit childproof as well.

DETAILED DESCRIPTION OF THE INVENTION

Figure 1:
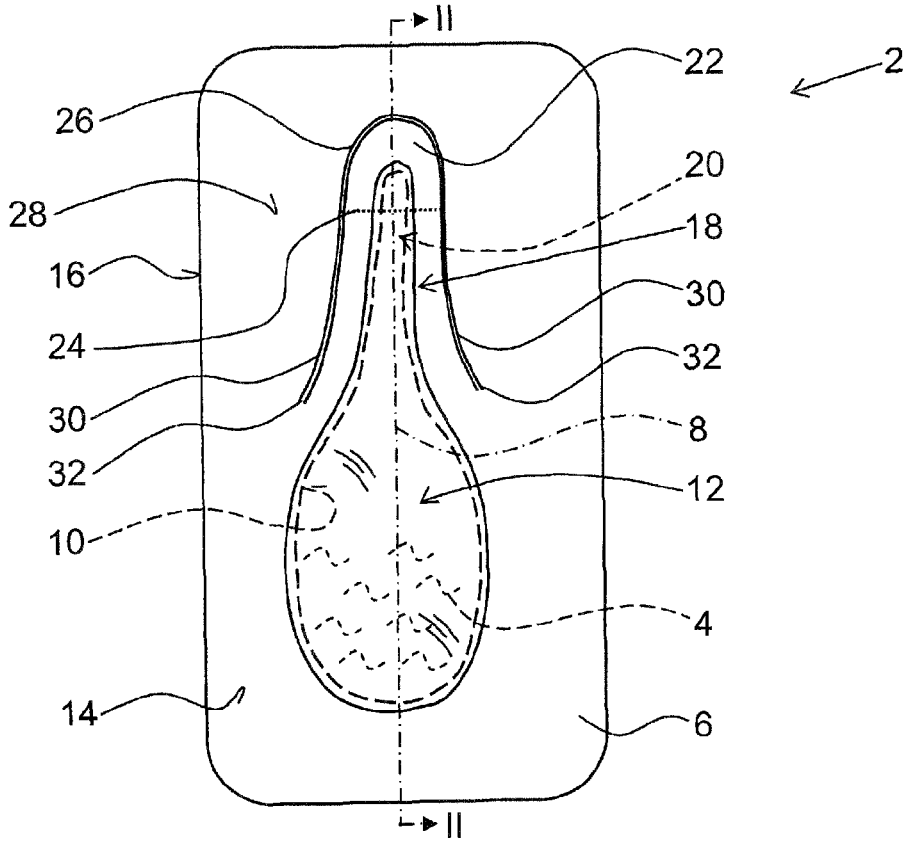
FIG. 1 is a front view of a packaging unit according to the invention.
Figure 2:
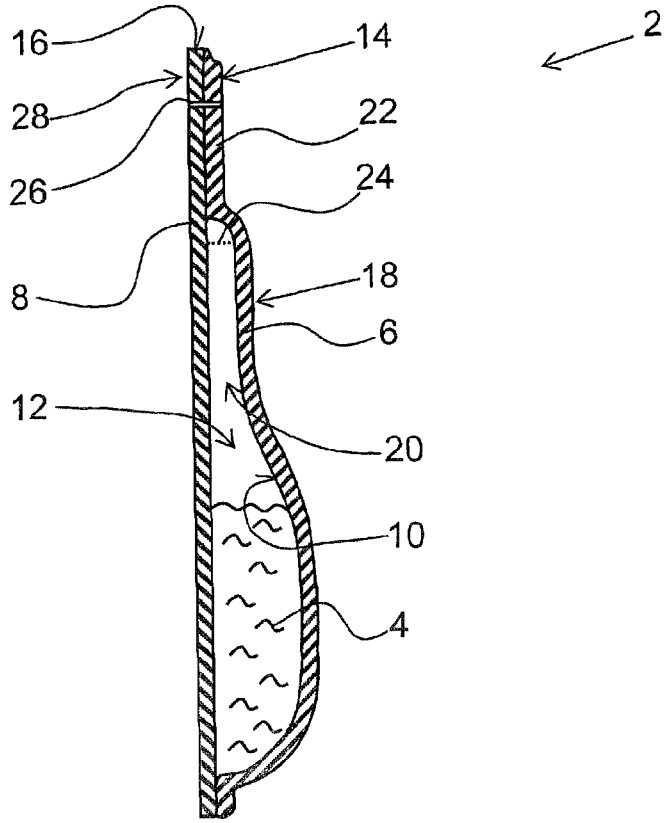
FIG. 2 is a longitudinal cross-sectional view through the packaging unit in the plane II of FIG. 1.

FIGS. 1 and 2 show a packaging unit 2 for containing and dosing, or dispensing, a medium 4 that may be made up, for example, of a fluid from the fields of medicine, cosmetics, chemistry, or the food industry.

The packaging unit 2 is formed for this purpose substantially of a first planar element 6 and a second planar element 8. These planar elements 6, 8 may be produced, for example, from a plastic material in the form of a foil, or may be cast, or molded, parts or deep-drawn parts.

In this embodiment, the first planar element 6 has, as can be seen in particular in FIG. 2, a bulged contour 10 that forms a chamber 12 that is closed by the second planar element 8 and in which medium 4 is stored.

Around chamber 12, the two elements 6, 8 form a collar region 14 in which the two elements are joined to each other. The union, or joint, between elements 6, 8 may be created by gluing, welding or sealing, for example. Toward the outside, collar region 14, and packaging unit 2 as a whole, are bounded by an outer edge 16.

To provide for a controlled dispensing of medium 4, chamber 12 is provided with a tapering, or tapered section, 18 forming an outlet path 20 that is in communication with chamber 12. Via this outlet path 20, medium 4 is able to exit from chamber 12.

To achieve this, tapering 18 extends into a detachable, or removable, section 22 that is detachable from the remaining collar region 14. To this end, detachable section 22 has a predetermined break line 24 that intersects the tapering 18, as well as a material weakening 26, in the form of a line or region, that extends in a U-shape about tapering 18. Material weakening 26, which, by way of example, is formed by a cut, separates detachable section 22 from a portion of collar region 14 that covers detachable section 22 toward outer edge 16 and consequently functions as a protective section 28.

Due to the U-shaped design of material weakening 26, it has two weakened sections 30 that extend on opposite sides of tapering 18 to respective ends 32 of weakening 26. Weakened sections 30 bound predetermined break line 24 on both sides in order to attain an increased bending stiffness of the protective section 28 relative to predetermined break line 24.

Figure 3:
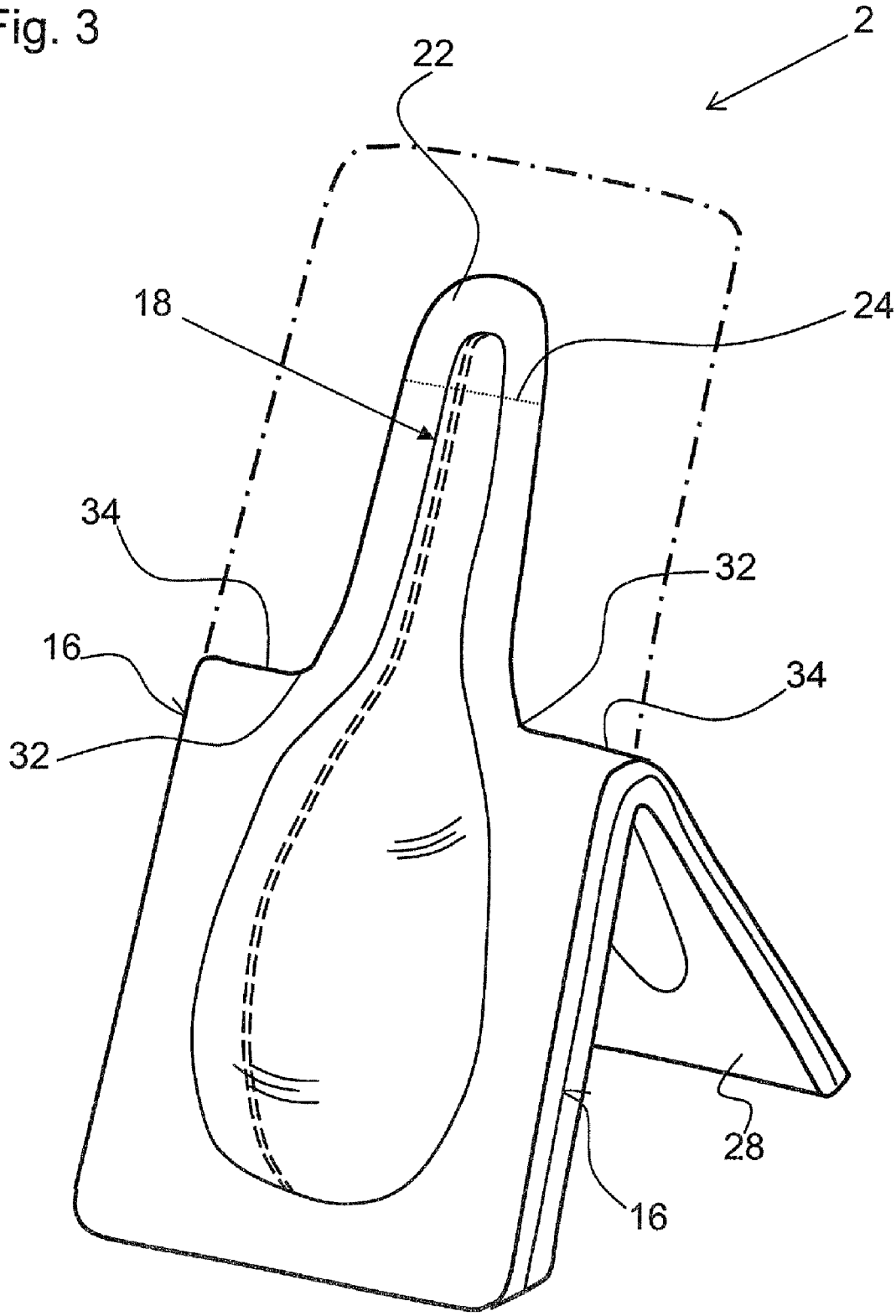
FIG. 3 is a perspective view of the packaging unit according to FIG. 1 with a deflected protective section.

To open packaging unit 2, as shown in FIG. 3, protective section 28 that initially covered detachable section 22 is first deflected, or bent, relative to section 22. This creates two bend sections 34 that are defined in their position by the two ends 32 and that extend in each case from the respective end 32 to outer edge 16.

This frees the detachable section 22, which can now be removed or bent by breaking the predetermined break line 24 to open tapering 18.

In the exemplary embodiment shown in FIGS. 1-3, the material properties of the two planar elements 6, 8 are defined, according to principles known in the art, such that protective section 28, after its deflection, remains in the position shown in FIG. 3. This allows the protective section to function as a support whereby the packaging unit 2 can be set down with tapering 18 facing upward, without the medium 4 being able to spill out.

Figure 4:
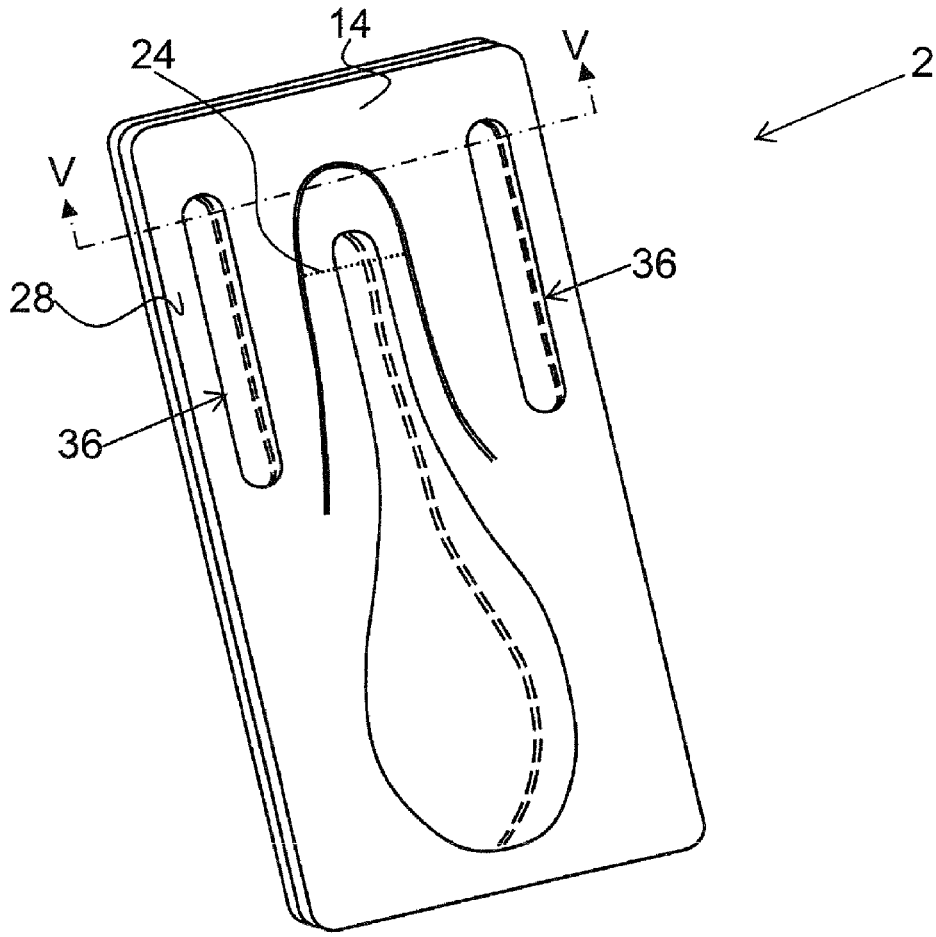
FIG. 4 is a perspective view of an alternative embodiment of the packaging unit according to the invention with stabilizing means.
Figure 5:
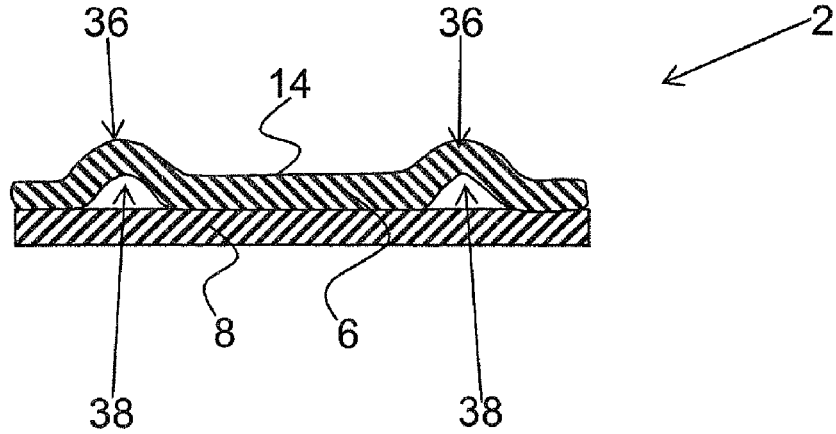
FIG. 5 is a cross-sectional view through the alternative packaging unit in plane V of FIG. 4.

FIGS. 4 and 5 show another embodiment of the packaging unit 2 in which additional stabilizing means 36 are provided on collar region 14 that stiffen protective section 28, thereby significantly increasing its bending stiffness relative to the bending stiffness of the predetermined break line 24. Stabilizing means 36 are formed as ribs by deep-drawn regions 38 of the first planar element 6 in collar region 14, as can be seen particularly well in FIG. 5.

Figure 6:
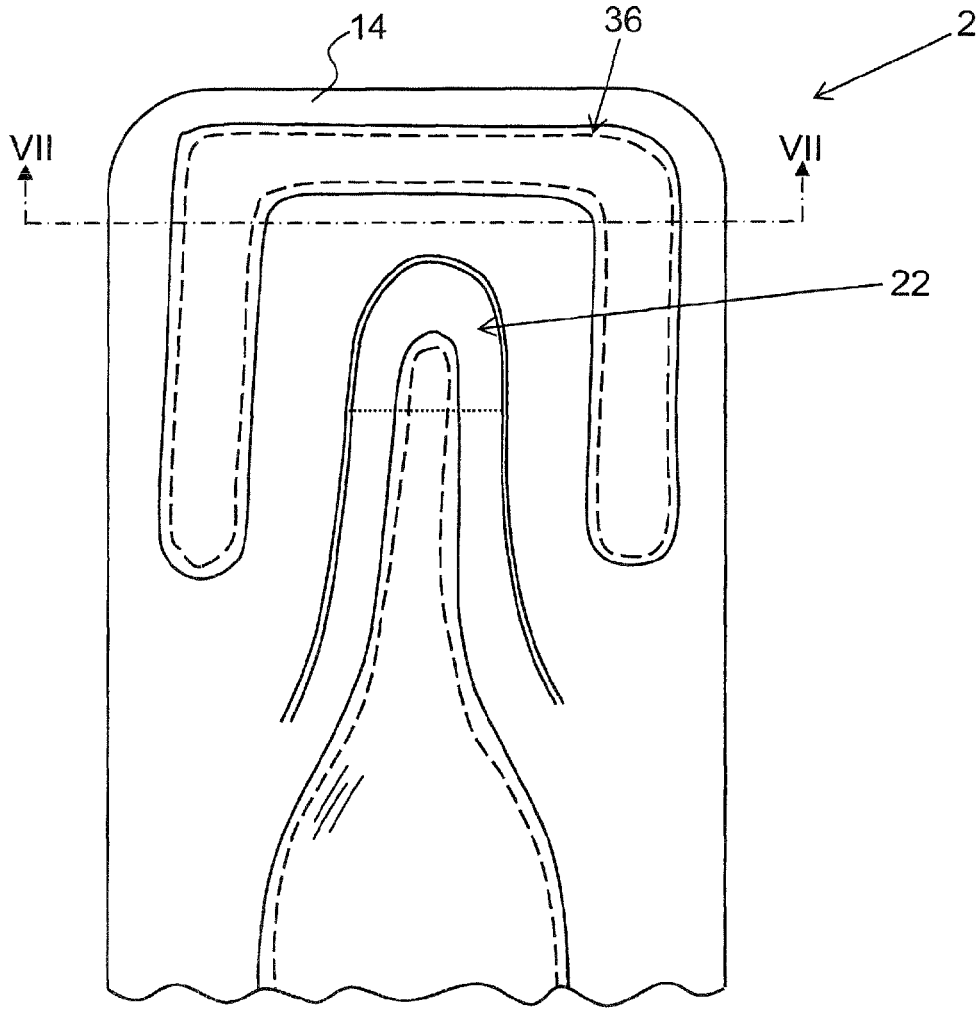
FIG. 6 is a perspective view of an upper portion of the packaging unit according to FIG. 4 with an alternative embodiment of the stabilizing means.
Figure 7:
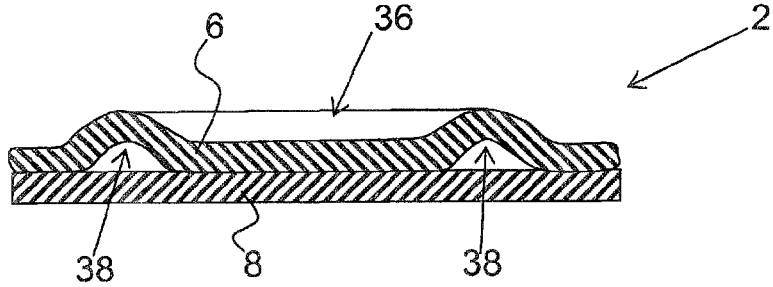
FIG. 7 is a cross-section view through the alternative stabilizing means in plane VII of FIG. 6.

FIGS. 6 and 7 show an additional embodiment of the packaging unit 2 in which the stabilizing means 36 are formed by a single deep-drawn region 38 that is recessed into first planar element 6 and extends in a U-shape about detachable section 22.

Figure 8:
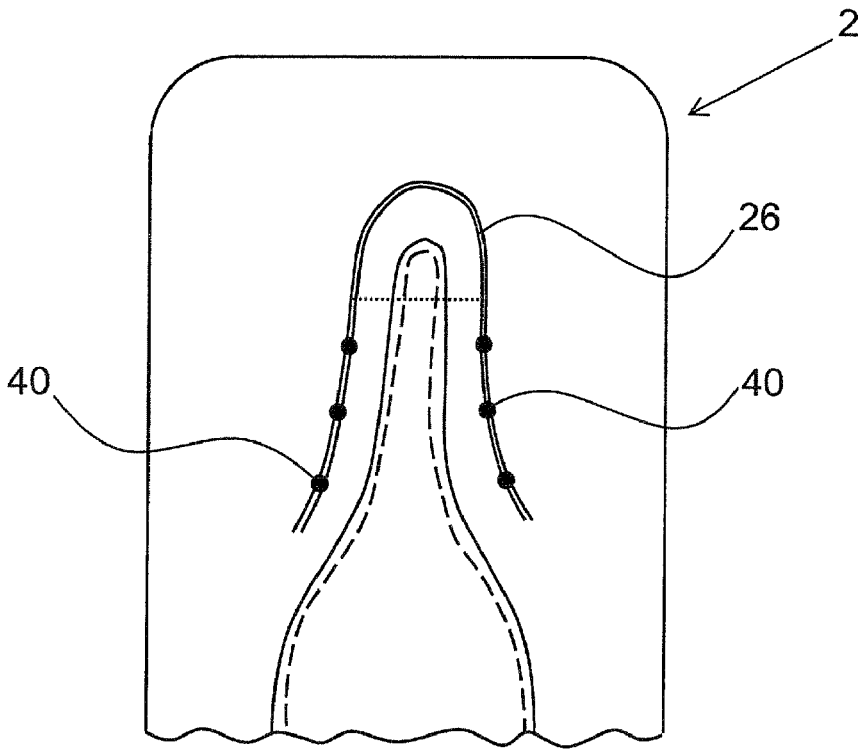
FIG. 8 is a front view of the upper part of the packaging unit according to FIG. 1 with an alternative material weakening.

In the embodiment shown in FIG. 8, a plurality of adhesion points 40 that are formed, for example, by a retroactively applied adhesion means, may be provided along the material weakening 26 that is designed in the form of a full-length cut.

Figure 9:
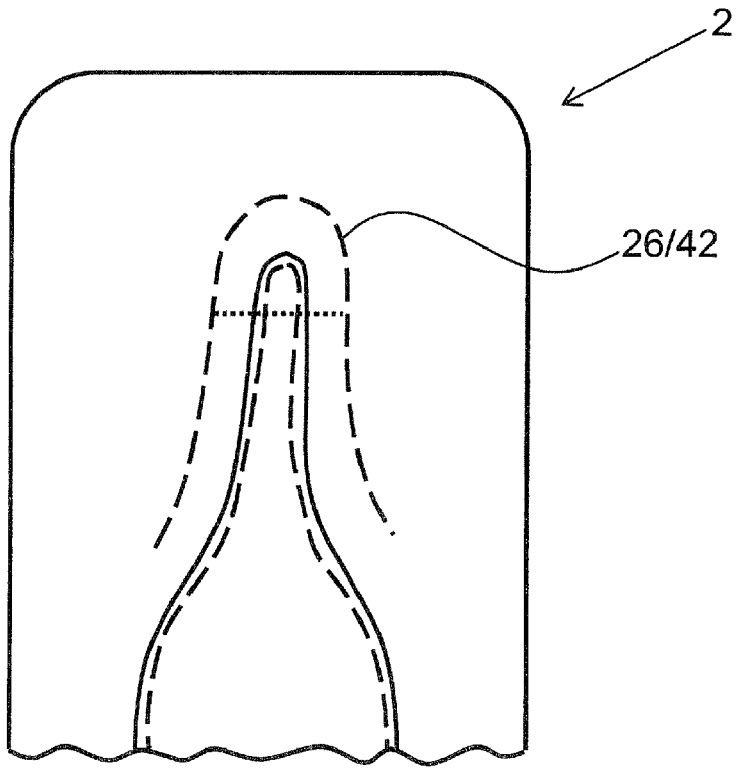
FIG. 9 is a view similar to that of FIG. 8 of the packaging unit according to FIG. 1 with a material weakening designed alternatively in the form of a perforation.

Alternatively, however, the material weakening 26 may also be formed by perforations 42, as shown in FIG. 9.

Figure 10:
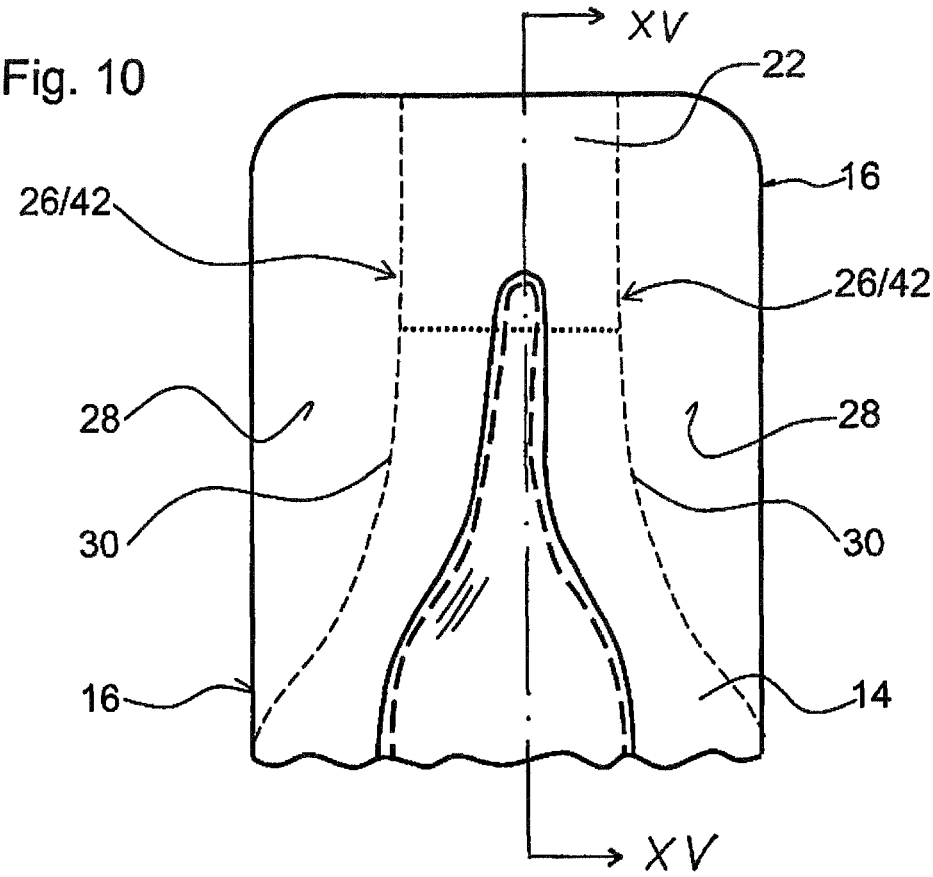
FIG. 10 is a view similar to that of FIG. 8 of a packaging unit with a material weakening in the form of a perforation that has two weakened sections extending on both sides to an outer edge.
Figure 11:
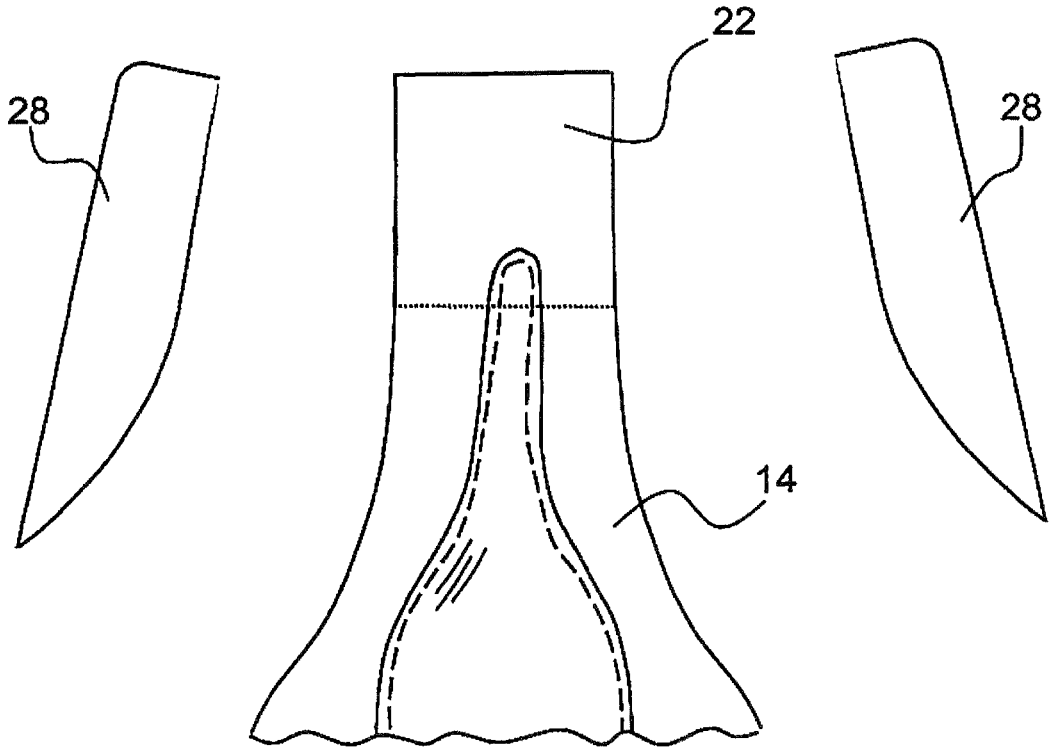
FIG. 11 is a detail view of the packaging unit according to FIG. 10 with the protective sections removed.

With the design of material weakening 26 in the form of perforations 42, it is additionally also possible to design the two weakened sections 30 to be separate from each other, as shown in FIG. 10, and extend them on both sides to outer edge 16. This makes it possible to completely remove the two protective sections 28 that are formed separately by the weakened sections 30 from the remaining collar region 14 to free the detachable section 22, as shown in FIG. 11.

Figure 12:
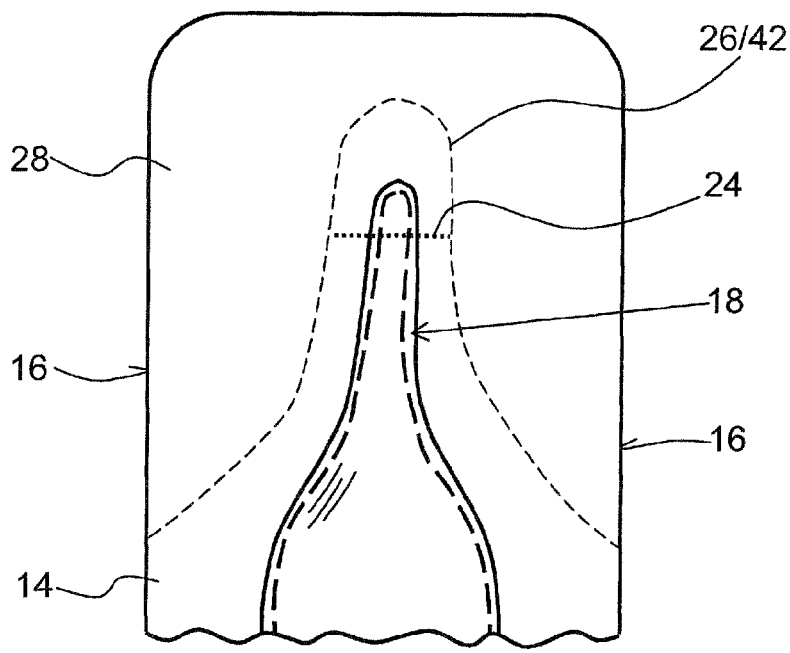
FIG. 12 is a view similar to that of FIG. 8 of a packaging unit with a material weakening designed in the form of a perforation that extends in a U-shape about a tapering and extends on both sides to the outer edge of the packaging unit.
Figure 13:
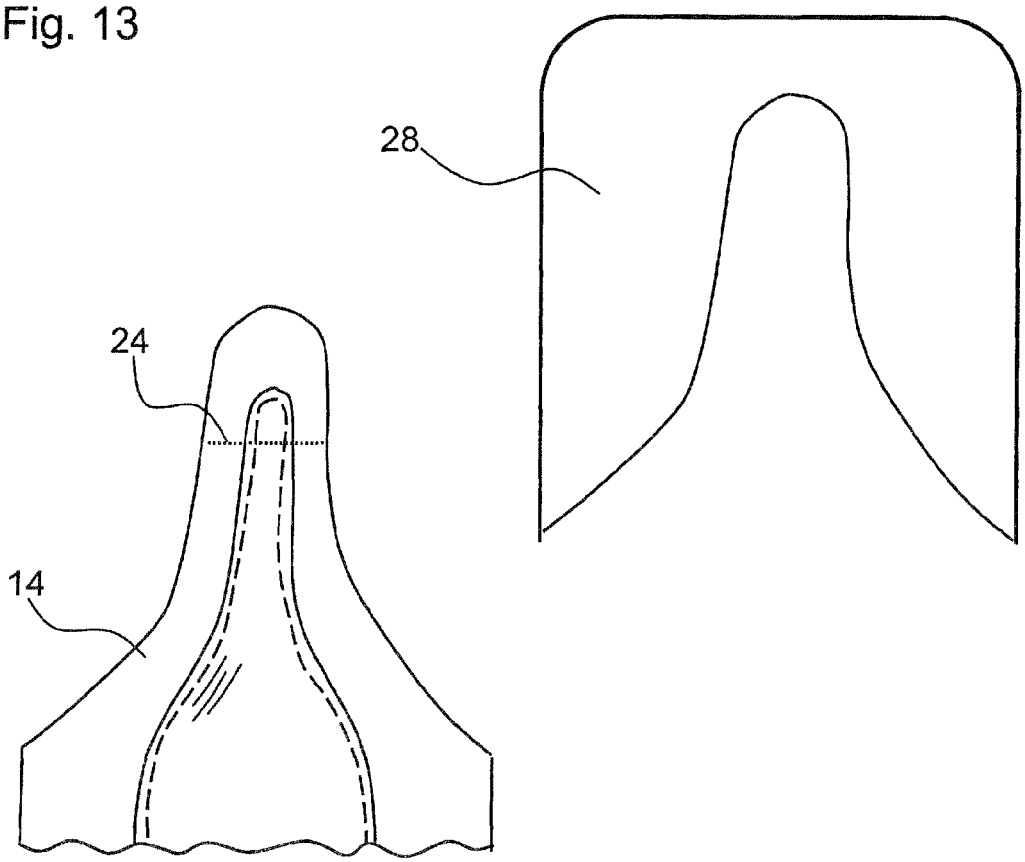
FIG. 13 is an exploded view of the packaging unit according to FIG. 12 with the protective sections removed.

Alternatively, the material weakening 26 that is designed in the form of perforations 42 may also be given a U-shaped about tapering 18 and extended on both sides to outer edge 16, as depicted in FIGS. 12 and 13. In this manner, the now one-piece U-shaped protective section 28 may be completely removed from the remaining collar region 14, freeing the predetermined break line 24 on both sides in the process.

Figure 14:
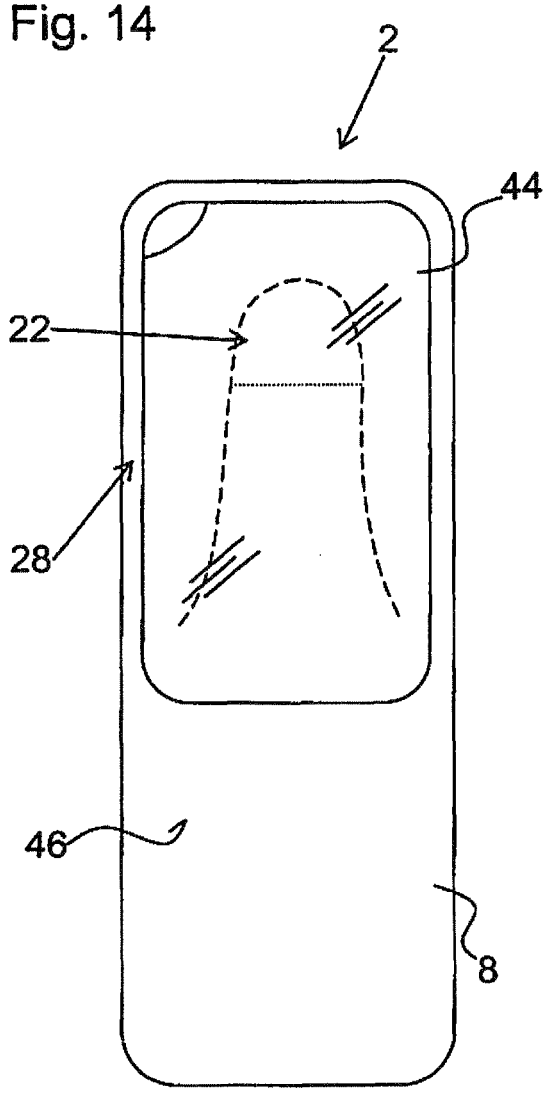
FIG. 14 is a rear view of the packaging unit according to FIG. 1 with a foil provided thereon.
Figure 15:
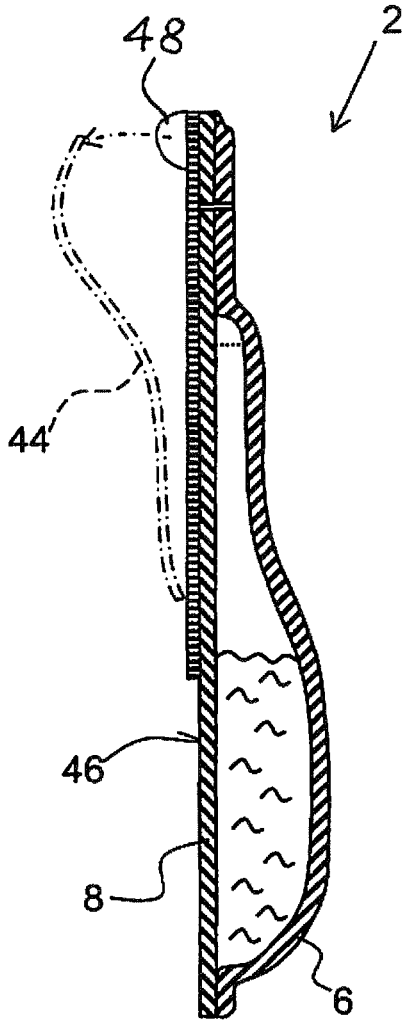
FIG. 15 is a longitudinal cross-sectional view through the packaging unit in plane XV of FIG. 10 with the foil removed.

FIGS. 14 and 15 show an additional embodiment of the packaging unit 2 in which a peelable foil 44 is provided that is disposed on a rear surface 46 formed by the second planar element 8. This foil 44 extends both over detachable section 22 and over protective section 28 and adheres to both.

In order to move protective section 28 away from detachable section 22 in order to open packaging unit 2, as described above, foil 44 must first be peeled off, as shown in FIG. 15. A non-adhering pull-tab 48 is provided for this purpose on the foil 44.

This application relates to subject matter disclosed in German Patent Application 10 2008 009 713.6-27, filed on Feb. 19, 2008, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A packaging unit (2) having two planar elements (6, 8) arranged on each other that form, by virtue of being spaced apart in certain regions, a closed chamber (12), said packaging element having a collar region (14) that joins said planar elements to each other and that encircles said chamber (12), said collar region (14) being bounded by an outer edge (16), wherein said packaging unit further has a detachable section (22) that is detachable from the collar region (14) and on which a predetermined break line (24) is provided, said chamber (12) has, for a controlled dispensing of a medium (4) stored in said chamber, a tapering (18) intersected by the predetermined break line and extending into said detachable section (22), the predetermined break line (24) being provided for creating an opening at the tapering (18), and further wherein said collar region (14) has a protective section (28) that at least partly surrounds said detachable section (22) toward said outer edge (16), said two planar elements are joined together in said protective section to be fixed in order to form a support that allows said packaging unit to be set down with said tapering facing upward to prevent the medium from spilling out of said chamber, and said detachable section (22) is bounded by a material weakening (26) that is recessed at a distance from said outer edge (16) into said collar region (14) and separates said detachable section (22) from said protective section (28), and wherein said collar region (14) has, in extension of said predetermined break line (24) at least one stabilizing means (36) that stiffen the protective section (28).

2. The packaging unit according to claim 1, wherein the protective section (28) has, in extension of said predetermined break line (24), an increased bending stiffness relative to said predetermined break line (24).

3. The packaging unit according to claim 2, wherein said predetermined break line (24) is bounded by the material weakening (26).

4. The packaging unit according to claim 1, wherein said at least one stabilizing means (36) is formed by a deep-drawn region (38).

5. The packaging unit according to claim 4, wherein said deep-drawn region (38) extends in a U-shape about said detachable section (22).

6. The packaging unit according to claim 5, wherein said material weakening (26) has two weakened sections (30) that extend on opposite sides of said tapering (18) crosswise to said predetermined break line (24).

7. The packaging unit according to claim 6, wherein each of said two weakened sections (30) extends on a respective side of said outer edge (16).

8. The packaging unit according to claim 6, wherein said material weakening (26) extends in a U-shape about said tapering (18) and said two weakened sections (30) are formed by opposed sections of said material weakening (26).

9. The packaging unit according to claim 8, wherein said U-shaped material weakening (26) extends on both sides to said outer edge (16).

10. The packaging unit according to claim 8, wherein said U-shaped material weakening (26) has two ends (32) disposed at a distance from said outer edge (16).

11. The packaging unit according to claim 10, which has a length along which said material weakening (26) is formed by a cut.

12. The packaging unit according to claim 11, wherein said material weakening (26) is provided, over the length of the cut, with a plurality of adhesion points (40).

13. The packaging unit according to claim 10, wherein said material weakening is formed by perforations (42).

14. The packaging unit according to claim 13, wherein said predetermined break line (24) is formed by creasing and scoring.

15. The packaging unit according to claim 1, further comprising a peelable foil (44) that adheres to said detachable section (22) and to said protective section (28).

16. The packaging unit of claim 1, wherein:

the two planar elements comprise a part that surrounds the tapering;

said material weakening (26) has two ends (32) disposed at a distance from said outer edge (16), and is configured to allow bending of the protective section (28) relative to the remaining collar region so that the packaging unit can be set down substantially upright after opening; and said protective section is joined to said part that surrounds the tapering by a connection along said material weakening that is constructed to be broken to allow the bending of the protective section (28) relative to the remaining collar region.

17. The packaging unit of claim 1, wherein said protective section is constructed and positioned for shielding the detachable section and the predetermined break line and stabilizing the detachable section and the predetermined break line against inadvertently applied forces, so as to prevent a premature unintentional breaking of the predetermined break line, and thereby prevent medium that is stored in the chamber from leaking out.

18. A packaging unit (2) comprising:

two planar elements (6, 8) arranged on each other that form, by virtue of being spaced apart in certain regions, a closed chamber (12);

a collar region (14) that joins said planar elements to each other and that encircles said chamber (12), said collar region (14) being bounded by an outer edge (16);

a detachable section (22) that is detachable from the collar region (14) and on which a predetermined break line (24) intersecting a tapering (18) is provided for creating an opening at the tapering (18);

wherein said chamber (12) has, for a controlled dispensing of a medium (4) stored in said chamber, a tapering (18) extending into said detachable section (22);

a protective section (28) in said collar region (14) that partly surrounds said detachable section (22) toward said outer edge (16);

a material weakening (26) that bounds said detachable section (22) and is recessed at a distance from said outer edge (16) into said collar region (14) and separates said detachable section (22) from said protective section (28); and at least one stabilizing means (36) in said collar region (14), that is in extension of said predetermined break line (24) and is formed by a deep-drawn region (38), to stiffen the protective section (28), wherein said deep-drawn region (38) extends in a U-shape about said detachable section (22);

wherein said material weakening (26) extends in a U-shape about said tapering (18) and has two weakened sections (30) that are formed by opposed sections of said material weakening (26) and extend on opposite sides of said tapering (18) crosswise to said predetermined break line (24), and said U-shaped material weakening (26) has two ends (32) disposed at a distance from said outer edge (16), and is configured to allow bending of the protective section (28) relative to the remaining collar region so that the packaging unit can be set down substantially upright after opening, and wherein said two planar elements are joined together in said protective section to be fixed in order to form a support that allows said packaging unit to be set down with said tapering facing upward to prevent the medium from spilling out of said chamber.

19. The packaging unit of claim 18, wherein said material weakening is provided with a plurality of adhesion points.

20. The packaging unit of claim 18, wherein said material weakening is formed by perforations.

21. The packaging unit of claim 18, wherein said protective section is constructed and positioned for shielding the detachable section and the predetermined break line and stabilizing the detachable section and the predetermined break line against inadvertently applied forces, so as to prevent a premature unintentional breaking of the predetermined break line, and thereby prevent medium that is stored in the chamber from leaking out.

* * * * *